United States Patent [19]

Belk

[11] 3,932,902

[45] Jan. 20, 1976

[54] CONVERTIBLE SOFA BED

[75] Inventor: Earl H. Belk, Long Beach, Calif.

[73] Assignee: Kustom Fit Manufacturing Company, Los Angeles, Calif.

[22] Filed: Jan. 10, 1975

[21] Appl. No.: 539,978

[52] U.S. Cl. ..... 5/28; 5/13; 297/65

[51] Int. Cl.[2] ..... A47C 17/40

[58] Field of Search ..... 5/12, 13, 14, 21, 27–31, 5/37 R, 47; 297/63–65, 92, 94

[56] References Cited

UNITED STATES PATENTS

| | | | |
|---|---|---|---|
| 3,162,481 | 12/1964 | Gaylor | 297/65 |
| 3,171,684 | 3/1965 | Carte | 297/65 |
| 3,282,625 | 11/1966 | Logan | 297/65 |

*Primary Examiner*—Casmir A. Nunberg

*Attorney, Agent, or Firm*—Fulwider, Patton, Rieber, Lee & Utecht

[57] ABSTRACT

A convertible sofa bed particularly adapted for use in recreational vehicles. The bed includes a frame, a seat portion, and a back portion pivotally connected to the seat portion for movement between a horizontal and an upright position. A pair of pivot assemblies at opposite sides of the seat frame each includes front and rear pivot arms, one attached to the seat portion and the other to the back portion. A connecting link attached to the arms constrains them against movement independently of one another. The arms and connecting link are arranged and oriented to pivot one way to project the seat portion forwardly and move the back portion to a horizontal position to form a bed. Pivoting them the opposite way retracts the seat portion and moves the back portion to an upright position, converting the structure from a bed to a sofa.

5 Claims, 6 Drawing Figures

FIG. 1
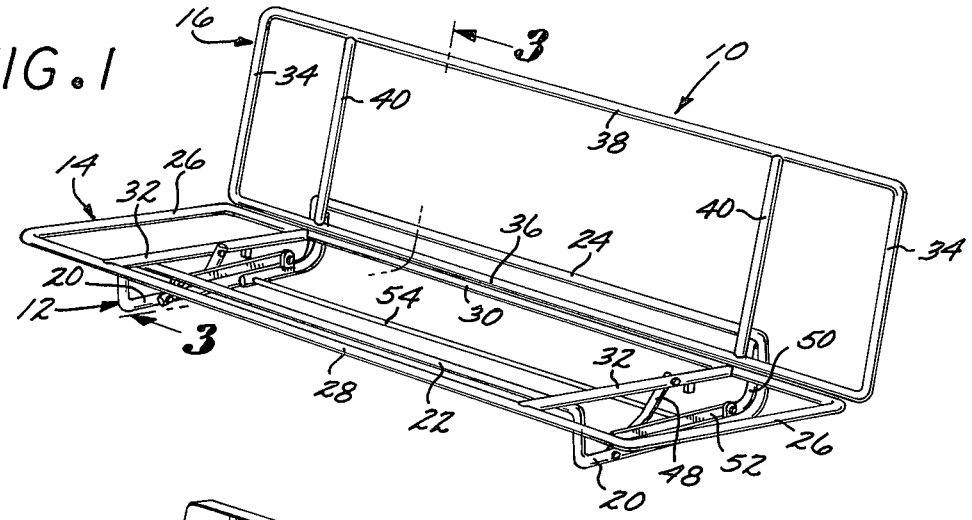
FIG. 2
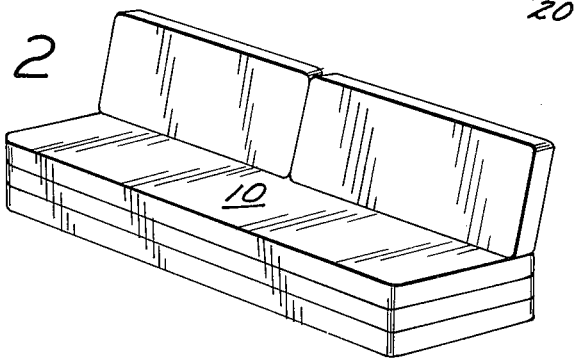
FIG. 3
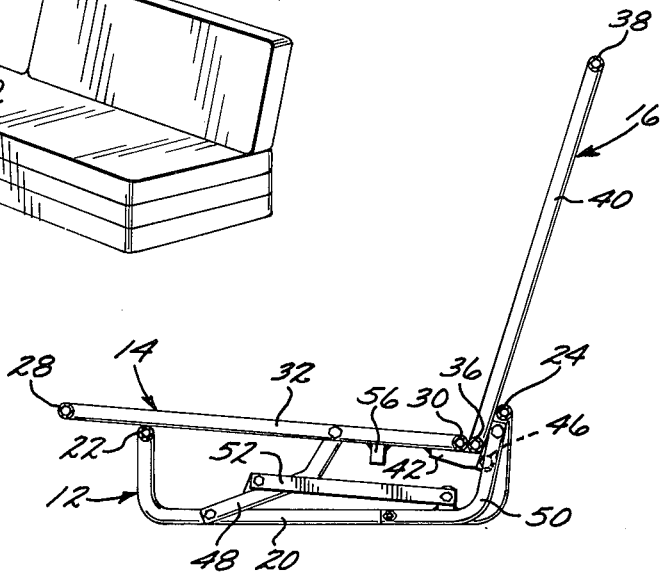
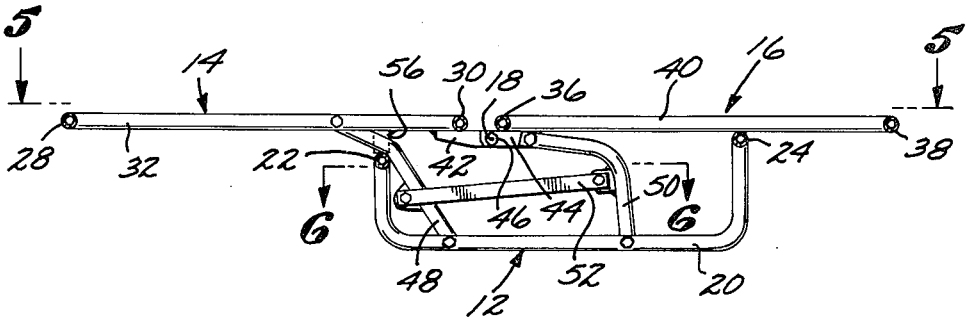
FIG. 4

CONVERTIBLE SOFA BED

BACKGROUND OF THE INVENTION

1. Field of the Invention

The present invention relates to a convertible sofa bed and more particularly to a sofa bed adapted for use in vehicles.

2. Description of the Prior Art

There are various sofa beds in the prior art convertible from a sofa to a bed structure. Most utilize a relatively complex linkage system to effect the conversion, and auxiliary support structure is usually provided to afford the desired rigidity and stability in the bed position. However, such complexity increases the expense of the unit, adds unnecessary weight, and presents a continuing maintenance problem. Desirably, the structure should be as simple as possible and be designed to take maximum advantage of the load bearing capability of the fewer components characteristic of simpler, more straightforward designs.

SUMMARY OF THE INVENTION

According to the present invention, a convertible sofa bed is provided which includes a back portion pivotally connected to a seat portion, with both of the portions being movable forwardly into horizontal, coplanar relation to form a bed. The portions are movable rearwardly to define a sofa, with the seat portion automatically oriented in an upright position. Pivot assemblies at opposite sides of the sofa bed are each characterized by front and rear pivot arms connected, respectively, to the seat and back portions. These connections are on opposite sides of the pivotal connection between the seat and back portions in an arrangement generally analogous to a parallelogram linkage, but with the upper section of the linkage hinged between the arm connections. A connecting link is pivotally fastened to the pivot arms to provide a controlled pivotal movement of the seat and back portions defining such upper section, and also to constrain the seat and back portions against movement independently of one another, particularly in the sofa and bed positions of the structure.

Stability of the structure in the bed position is improved by a stop mounted to the seat portion, and by the front pivot arm, both of which engage the front of the frame in the bed position. Stability in the sofa position is provided by engagement of the back of the frame by the back portion and suspension of the rear pivot arm from the generally upright back portion. Engagement of the frame thus constrains the seat and back portions against further pivotal movement, providing a very solid, stable structure, compared to structures of the priot art. Moreover, load transfer from the seat and back portions is thus directly to the frame, and not to the floor through intermediate linkages, auxiliary legs or supports. This effects an economy of parts and consequently reduces the cost of manufacture and maintenance.

Other objects and features of the invention will become apparent from consideration of the following description taken in connection with the accompanying drawings.

BRIEF DESCRIPTION OF THE DRAWINGS

FIG. 1 is a perspective view of a convertible sofa bed according to the present invention;

FIG. 2 is a perspective view of the sofa bed as it would appear after upholstering;

FIG. 3 is an enlarged cross-sectional view taken along the line 3—3 of FIG. 1, illustrating the sofa bed in its sofa position;

FIG. 4 is a view similar to FIG. 3, but illustrating the sofa bed in its bed position;

DESCRIPTION OF THE PREFERRED EMBODIMENT

Figure 5:
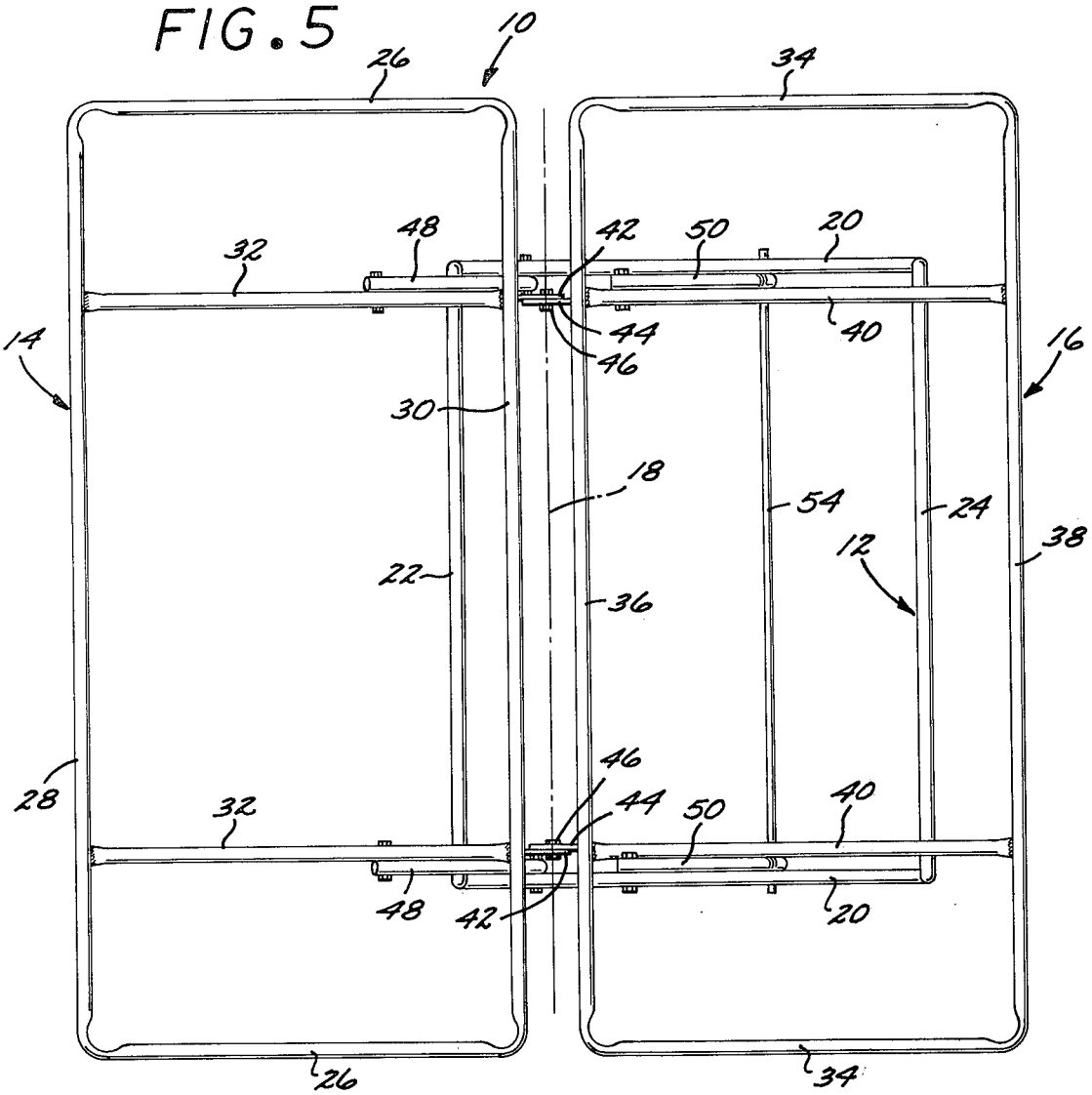
FIG. 5 is a view taken along the line 5—5 of FIG. 4.
Figure 6:
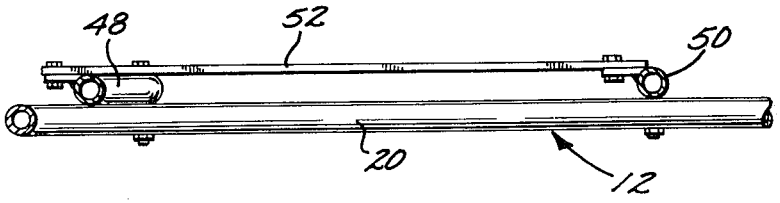
FIG. 6 is an enlarged view taken along the line 6—6 of FIG. 4.

Referring now to the drawings, there is illustrated a convertible sofa bed 10 according to the present invention and comprising, generally, a frame 12; a seat portion 14 overlying the frame 12; and a back portion 16 also overlying the frame 12 and pivotally connected to the seat portion 14 for pivotal movement about a hinge axis 18.

In the sofa position illustrated in FIG. 3, the seat portion 14 is generally horizontally oriented, having a slight upward and forward slope for comfort. The back portion 16 is generally vertical or upright, having a slight backward tilt. In the bed position illustrated in FIG. 4, the seat and back portions 14 and 16 are both generally horizontal and arranged in coplanar relation. In moving from the sofa position of FIG. 3 to the bed position of FIG. 4, the seat and back portions 14 and 16 are projected forwardly, that is, to the left as viewed in FIGS. 3 and 4, as the back portion 16 pivots from its upright to its horizontal position. Consequently, since the upper end of the seat portion 14 thereby tends to move generally downwardly, rather than rearwardly, the back of the sofa bed 10 can be located relatively close to a wall or the like. The back portion 16 will easily move between its sofa and bed positions without any need to move the structure away from the wall. This is particularly advantageous where the bed 10 is used in a confined space, such as within a motor home or similar vehicle.

The frame 12 may take any configuration suitable for support of the seat and back portions 14 and 16. Preferably the frame 12 and portions 14 and 16 are all made of light weight structural tubing or the like. The frame 12 includes U-shape side members 20 joined in front by a horizontal, transversely extending integral front element 22, and at the rear by a horizontal, transversely extending integral rear element 24, the rear element 24 preferably being somewhat higher in elevation than the front element 22 to better support the back portion 16 in its sofa position.

The generally rectangular seat portion 14, which extends laterally outwardly of the side members 20 of the frame 12, is defined by a pair of side members 26 integrally joined by a pair of front and rear elements 28 and 30. The seat portion 14 also includes a pair of intermediate elements 32 welded to the elements 28 and 30 in general vertical alignment with the side members 20 of the frame 12.

The construction of the generally rectangular back portion 16 is substantially identical to that of the seat portion 14, including side members 34 integrally joined by front and rear elements 36 and 38. The back portion 16 also includes a pair of intermediate elements 40 welded to the front and rear elements 36 and 38 in general alignment with the side members 26 of the seat portion 14, as best seen in FIG. 5.

The frame 12, seat portion 14 and back portion 16 may be upholstered in any desired fashion, one style being illustrated in FIG. 2. Although not illustrated, the sofa bed would preferably include suitable anchorages for attachment to the floor in a vehicle installation, as will be apparent.

The hinging or pivotal interconnection between the seat and back portions 14 and 16 includes a pair of straps 42 and 44 located at each side of the frame 12 in general vertical alignment with the frame side members 20. Each strap 42 is welded to the seat rear element 30 and the adjacent element 32, while the associated strap 44 is similarly welded to the back front element 36 and the adjacent element 40. The adjacent extremities of each pair of straps 42 and 44 are pivotably connected by a pin 46 which defines the hinge axis 18 about which the portions 14 and 16 pivot relative to one another.

A pivot assembly is provided at each side of the sofa bed 10 to effect the previously described projection and retraction of the portions 14 and 16, and accompanying upward and downward movement of the back portion 16. Each of these pivot assemblies comprises a front pivot arm 48 having a lower extemity pivotally connected to a frame side member 20, and an upper extremity pivotally connected to the adjacent one of the seat portion elements 32. The pivot point is forwardly of the rear element 30, about a third of the distance between the front and rear elements 28 and 30.

The upper extremity of the pivot arm 48 is bent or cranked so as to project forwardly in the bed position illustrated in FIG. 4 and engage the frame front element 22. In this position the arm 48 is constrained against further forward or counter-clockwise pivotal movement, and loading of the sofa bed is transferred by the arm 48 directly to the frame 12. In addition, a strap or stop 56 is welded to each of the seat portion elements 32 just rearwardly of the pivotal connections of the front arms 48 to the elements 32. The stops 56 depend from the elements 32 and engage the top of the frame front element 22 in the bed position of the sofa bed 10. The stops 56 prevent any tendency of the portions 14 and 16 to dip downwardly at the hinge axis 18. The positive constraint provided by the stops 56 thus gives a solid quality to the sofa bed. There is also the important advantage that looser tolerances are possible at the pivot connections of the arms 48 and 50 to the other sofa bed components. Such tolerances do not result in unwanted movement of the seat and back portions because the stops 56 engage the frame and prevent any movement which might otherwise occur. The pivot action is therefore freer, and manufacture and assembly is simpler, faster and less expensive. Close tolerance riveted pin connections are not necessary. Moreover, there is no need for auxiliary supporting legs or the like to support the free or cantilevered front edge of the seat portion 14.

Each pivot assembly also includes a rear pivot arm 50 having a lower extremity pivotally connected to the adjacent frame side member 20 at a point located rearwardly of the corresponding connection of the arm 48 to the frame 12. The upper extremity of the arm 50 is pivotally connected to the strap 44 of the back portion 16 at a point immediately adjacent the back portion front element 22, as best seen in FIG. 4. In the bed position of FIG. 4, the lower extremity of the arm 50 is generally vertically oriented, and the upper extremity is bent or cranked, thereby extending forwardly in the bed position. However, in the seat position of FIG. 3, the lower extremity of the pivot arm 50 pivots into close proximity with the floor or other supporting structure for the sofa bed, and the back portion 16 engages the frame rear element 24. Consequently, the pivot arm 50 cannot pivot further rearwardly. Thus, engagement of the frame by the seat and back portions establishes both the bed and sofa positions.

Each pivot assembly also includes a generally horizontally oriented connecting link 52 having a forward extremity pivotally attached to a mounting tab welded to the lower extremity of the front pivot arm 48. As seen in the drawings, the link 52 is straight and not cranked or curved. The rearward extremity of the link 52 is similarly pivotally attached to a mounting tab which is welded to the lower extremity of the rear pivot arm 50. With this interconnection the connecting link 52 constrains the arms 48 and 50 from movement independently of one another.

Each pivot assembly is generally analagous to a parallelogram linkage, the lower element of the linkage being defined by the frame 12, the upper element being defined by the connected seat and back portions 14 and 16, and the arms being defined by the pivot arms 48 and 50. However, the seat portions 14 and 16 do not define a rigid upper element, being pivotable relative to one another to enable movement of the back portion 16 between its horizontal and upright positions. However, the connecting link 52 prevents uncontrolled relative movement between the portions 14 and 16. More particularly, when the front pivot arm 48 is constrained against further forward pivotal movement, as seen in FIG. 4, the interconnection provided by the link 52 causes the pivot arm 50 to also be constrained against forward movement and, since both arms 48 and 50 cannot move, the seat and back portions 14 and 16 cannot pivot relative to one another out of the coplanar relation of FIG. 4. However, deliberate rearward movement of the portions 14 and 16 pivots both of the arms 48 and 50 together to the sofa position of FIG. 3. Similarly, in the sofa position, when the pivot arm 50 is constrained against further rearward movement, the interconnection provided by the link 52 causes the front pivot arm 48 to also be constrained against rearward movement and, since both of the arms 48 and 50 cannot move, the seat and back portions 14 cannot pivot relative to one another out of the sofa position of FIG. 3. However, deliberate forward movement of the portions 14 and 16 pivots both of the arms 48 and 50 together back to the bed position.

The location of the pivot axis of the rear pivot arm 50 immediately adjacent the hinge axis 18 has the effect of relatively rapidly upwardly pivoting the back portion 16 during its movement from the bed to the sofa position. Consequently, the degree of such pivotal movement can be adjusted by relocating the point of pivotal attachment as desired. However, the point of attachment illustrated has operated satisfactorily.

The length of the arms 48 and 50, and the extent of their pivotal movement, are preferably such that the back portion 16 is engaged upon the frame rear element 24 in both the bed position of FIG. 4 and the sofa position of FIG. 3, and the seat portion 14 is engaged upon the frame front element 22 in the sofa position.

A torsion rod 54 extends transversely of the frame 12 and is welded at its opposite extremities to the lower ends of the rear pivot arms 50. This causes the pair of pivot assemblies at the opposite sides of the frame 12 to operate in unison.

The sofa bed of the present invention provides a strong, relatively lightweight, and efficient structure readily adapted for use in motor homes and the like.

Various modifications and changes may be made with regard to the foregoing detailed description without departing from the spirit of the invention.

I claim:

1. A convertible sofa bed comprising:

a frame;

a seat portion;

a back portion pivotally connected to said seat portion for movement about a hinge axis and between generally horizontal and generally upright positions; and a pair of pivot assemblies, one at each side of said frame and each including a front pivot arm having opposite extremities pivotally connected to said frame and said seat portion, a rear pivot arm having opposite extremities pivotally connected to said frame and said back portion, said front and rear pivot arms being pivotable between raised positions wherein said front and back portions are forwardly projected and said front pivot arm is engaged upon said frame whereby said front pivot arm is prevented from further pivotal movement forwardly, and lowered positions wherein said front and back portions are rearwardly retracted, said rear pivot arm being connected to said back portion adjacent said hinge axis whereby said back portion is upwardly pivoted about said hinge axis in said retracted position, said pivot assemblies also each including a connecting link pivotally connecting said front and rear pivot arms whereby said rear pivot arm is prevented by said connecting link from pivoting forwardly in said raised position of said front pivot arm.

2. A sofa bed according to claim 1 and including a torsion rod interconnecting said pair of pivot assemblies for operation of said pivot assemblies in unison.

3. A sofa bed according to claim 1 wherein said frame, seat portion and back portion are fabricated of tubular material.

4. A sofa bed according to claim 1 wherein said seat portion includes depending stop means adapted to engage and rest upon the front of said frame in said horizontal position of said back portion.

5. A sofa bed according to claim 1 wherein said connecting link is straight.

* * * * *